US005562340A

United States Patent [19]

Lovell

[11] Patent Number: 5,562,340

[45] Date of Patent: Oct. 8, 1996

[54] OUTWARD PROTRUDING CORNER LIGHT AND SUPPORT BRACKET

[76] Inventor: Allan R. Lovell, 545 King Edward Street, Winnipeg, Manitoba, Canada, R3H 0N9

[21] Appl. No.: 402,362

[22] Filed: Mar. 13, 1995

[51] Int. Cl.[6] ..... F21S 1/02

[52] U.S. Cl. ..... 362/147; 362/368; 362/370; 362/396; 362/432; 248/220.1

[58] Field of Search ..... 362/147, 368, 362/370, 396, 432; 248/220.1, 227

[56] References Cited

U.S. PATENT DOCUMENTS

| | | | |
|---|---|---|---|
| 752,959 | 2/1904 | Currier | 362/368 |
| 1,799,944 | 4/1931 | Beardsley | 248/220.1 |
| 2,640,670 | 6/1953 | Lampe | 362/432 |
| 4,217,629 | 8/1980 | Russell | 362/147 |
| 4,352,151 | 9/1982 | Lewis | 362/368 |
| 4,590,544 | 5/1986 | Decandia | 362/368 |
| 5,057,980 | 10/1991 | Russell | 362/147 |
| 5,251,118 | 10/1993 | Budnovitch et al. | 362/362 |
| 5,297,011 | 3/1994 | Triunfol | 362/147 |
| 5,349,134 | 9/1994 | Russell | 362/432 |

FOREIGN PATENT DOCUMENTS

| | | | |
|---|---|---|---|
| 87357 | 5/1956 | Norway | 248/220.1 |

*Primary Examiner*—Denise L. Gromada
*Assistant Examiner*—Alfred Basichas
*Attorney, Agent, or Firm*—Robert W. B. Bailey

[57] ABSTRACT

A light canister for protruding and typically exterior building corners has support brackets, a vertical groove to accommodate the corner, and hooks inside the groove to engage the support bracket. The bracket has two corner contact plates connected by a protruding connection forming a space between the wall and itself when the bracket is attached. The hooks are dimensioned to fit snugly within the space. Both are conveniently V shaped.

20 Claims, 4 Drawing Sheets

OUTWARD PROTRUDING CORNER LIGHT AND SUPPORT BRACKET

This invention relates to outward protruding corner lights, support brackets, and support bracket kits therefor. While generally such a protruding corner is external to a building or structure, and the lights and bracket are so designed, such a protruding corner may be internal to a building or structure and as those skilled in the art would appreciate, such corner lights and brackets may be utilized on protruding internal corners.

There are no readily available outward protruding corner lights and support brackets to provide easily removable weatherproof light canisters.

There is thus a need for suitable easily removable weatherproof light canisters mountable on outward protruding corners, support brackets and support brackets kits therefor, are thus desirable.

The present invention contemplates light canisters having therein a vertically extending right angled groove to accommodate protruding corners, brackets attachable to protruding corners, hooks attachable within the groove to engage the brackets.

Although the invention will be described and referred to specifically as it relates to light canisters having therein a vertically extending right angled groove to accommodate protruding corners, wall mountable brackets attachable to protruding corners, and hooks attachable within the groove to engage the brackets, it will be understood that the principles of this invention are equally applicable to similar devices and accordingly, it will be understood that the invention is not limited to such devices.

BACKGROUND OF INVENTION

External corner lighting is desirable so that a light mounted on a corner can illuminate evenly, typically in the 270° arc around an exterior right angled corner. Another requirement is that the light generating lamp, bulb or tube be easily changeable. This is most easily done by having the canister removable from the corner, otherwise the canister must be taken apart in place, which is generally inconvenient. By having mounting brackets attached around the corner and detachably mounting the canister thereon, the canister is made removable. A vertical groove enables the canister to fit the corner more snugly and thus reduces any play caused by wind and weather. Hooks mounted within the canister grooves engage gaps formed between corner and mounting brackets. The close symmetrical mounting of the canister on the corner provides photometrically even lighting from the light or luminaire.

PRIOR ART

U.S. Pat. Nos. 2,640,670, 4,217,629, 4,352,151, 5,057,980, 5,251,118, 5,297,011 and 5,349,134, all teach corner attached lighting, of these 2,640,670, 521,118 and 5,297,011 teach lighting attached to protruding corners.

It is a primary object of the invention to provide removable corner mounted light canisters. It is a further primary object to provide mounting brackets attachable to both corner walls forming a gap abutting the corner. It is a further primary object to provide a vertically extending groove in the canister. It is a further primary object to provide hooks attachable to the canister groove, which are engageable in the mounting bracket gap when the brackets are mounted on the wall. Other objects will be apparent to those skilled in the art from the following specification and accompanying drawings and appended claims.

DESCRIPTION OF THE INVENTION

In a broad aspect the invention is directed to bracket means to removably mount a light canister on a protruding corner. The bracket has first and second contact plate means angled to contact the corner and interconnecting means connecting the first and second plate means and protruding outward therefrom, so that when the first and second plate means contact the corner the interconnecting means forms a space between the connecting means and the corner. Preferably the space is V shaped. Preferably the interconnecting means comprises first projecting means extending outward from the first contact plate means and second projecting means extending outward from the second contact plate means. First extending means extend from the first projecting means to meet second extending means extending from the second projecting means. More preferably the first and second contact plate means are mutually at right angles to contact the protruding corner. First projecting plate means extend outward substantially at right angles to the first contact plate means, second projecting plate means extend outward substantially at right angles to the second contact plate means, first extending plate means extend from the first projecting plate means, spaced apart from and parallel to the first contact plate means, to meet second extending plate means extending from the second projecting plate means, spaced apart from and parallel to the second contact plate means. Conveniently the first and second contact plate means comprise attachment aperture means.

In another broad aspect the invention is directed to light canister means for mounting on a protruding corner, which has groove means extending vertically when the canister means is mounted vertically. The groove means has mounted therein hook means. Typically the groove means is of right angled cross section. Preferably the hook means comprises groove contact plate means attached internally of the groove means. Flange means extend into the groove means from a first edge abutting the groove contact plate means to a second edge spaced apart from the groove contact plate means. Tab means extend along the groove means from the second edge means away from the groove contact plate means. Preferably the groove contact plate means comprises first and second groove contact plate means conjoined at right angles, abutting the groove means. The flange means extends into the groove means at right angles to both the groove contact plate means, forming an L shape. The tab means comprises first and second tab plate means conjoined at right angles to each other and the L shaped flange. Conveniently the first and second groove contact plate means comprise attachment aperture means.

In a further broad aspect the invention is directed to a kit to mount a light canister, which includes light canister means for mounting on a protruding corner comprising groove means extending vertically when the canister means is mounted vertically. Also provided are hook means adapted to be mounted in the groove means. While bracket means are supplied to removably mount the light canister on a protruding corner comprising first and second corner contact plate means for the corner and bracket connecting means connecting the first and second corner contact plate means and protruding outward therefrom so that when the first and second corner contact plate means contact the corner the connecting means forms a space between the bracket connecting means and the corner. The hook means has a dimensional cross section to engage the space. Preferably the groove means has mounted therein the hook means. Assembled the bracket means is mounted on the protruding corner, and the hook means engages the space. Preferably the groove means is of right angled cross section. Conveniently the hook means comprises groove contact plate means attached internally of the groove means. Flange means extend into the groove means from a first edge abutting the groove contact plate means to a second edge spaced apart from the groove contact plate means. Tab means extend along the groove means from the second edge means away from the groove contact plate means. The groove contact plate means may comprise first and second groove contact plate means at right angles, abutting the groove means. The flange means may extend into the groove means at right angles to both the groove contact plate means, forming an L shape. The tab means may comprise first and second tab plate means at right angles to each other and the L shaped flange. The bracket means space is preferably V shaped. More preferably the first and second groove contact plate means are conjoined and the first and second tab plate means are conjoined. Preferably the bracket interconnecting comprises first projecting means extending outward from the first corner contact plate means and second projecting means extending outward from the second corner contact plate means. While first extending means extend from the first projecting means to meet second extending means extending from the second projecting means. More preferably the bracket means comprises first and second corner contact plate means mutually at right angles to contact the protruding corner. First projecting plate means extends outward substantially at right angles to the first contact plate means, second projecting plate means extends outward substantially at right angles to the second contact plate means. First extending plate means extends from the first projecting plate means, spaced apart from and parallel to the first contact plate means, to meet second extending plate means extending from the second projecting plate means, spaced apart from and parallel to the second contact plate means. Conveniently the first and second corner contact plate means and the first and second groove contact plate means comprise aperture means.

DESCRIPTION OF THE PREFERRED EMBODIMENTS

Figure 1:
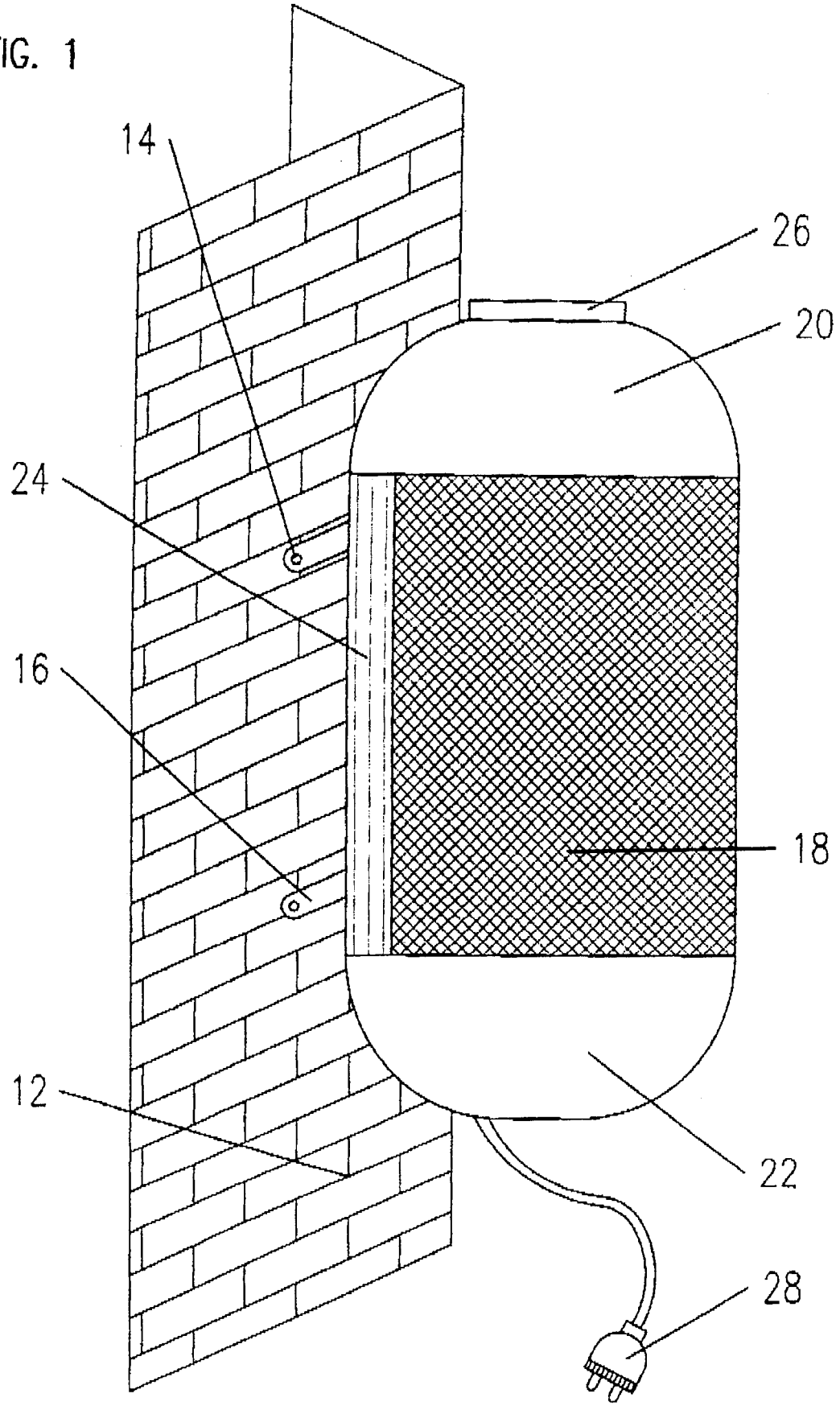
FIG. 1 shows a view of a light canister of the invention mounted on a protruding corner.
Figure 2:
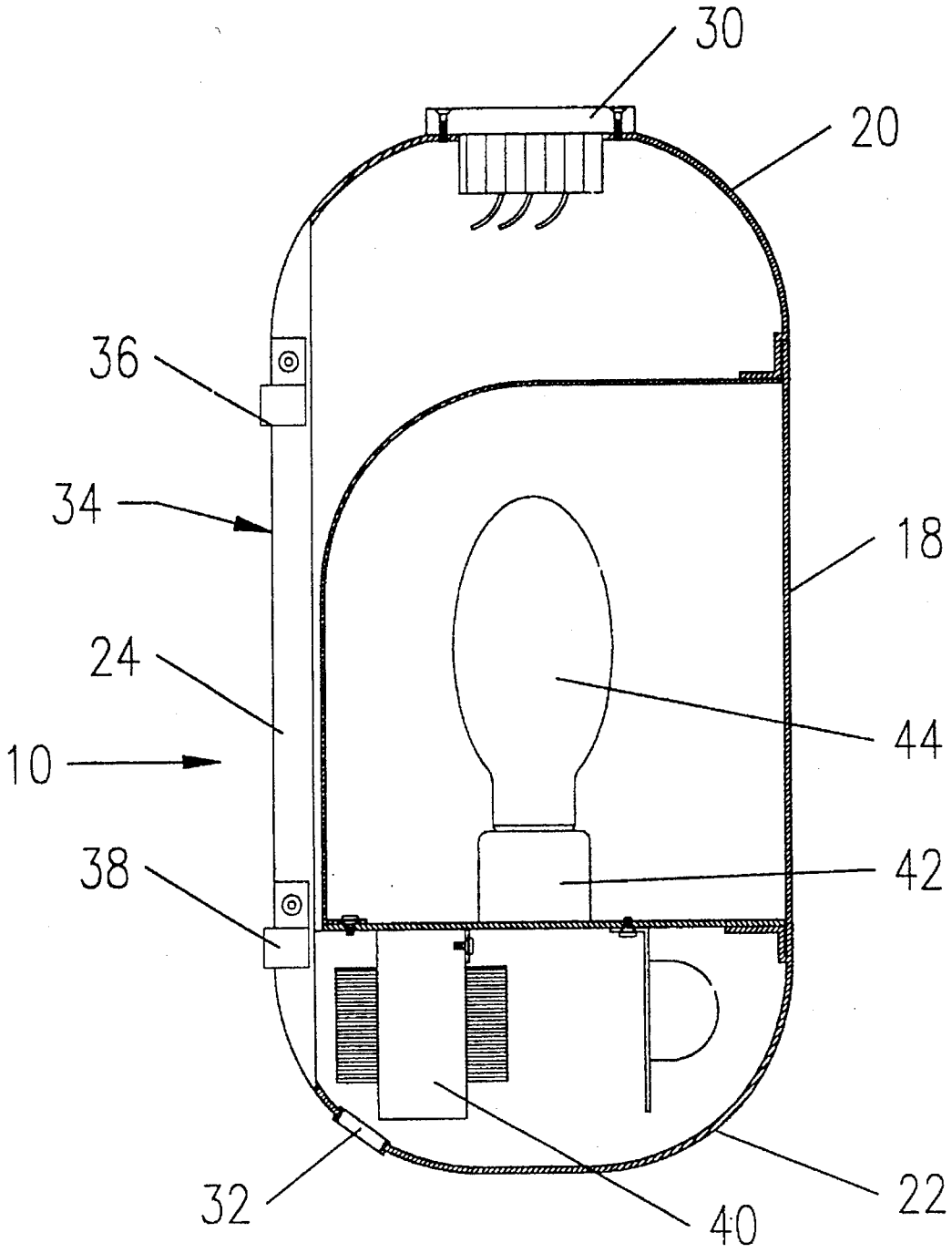
FIG. 2 shows a sectional view of the light canister of the embodiment of FIG. 1.
Figure 3:
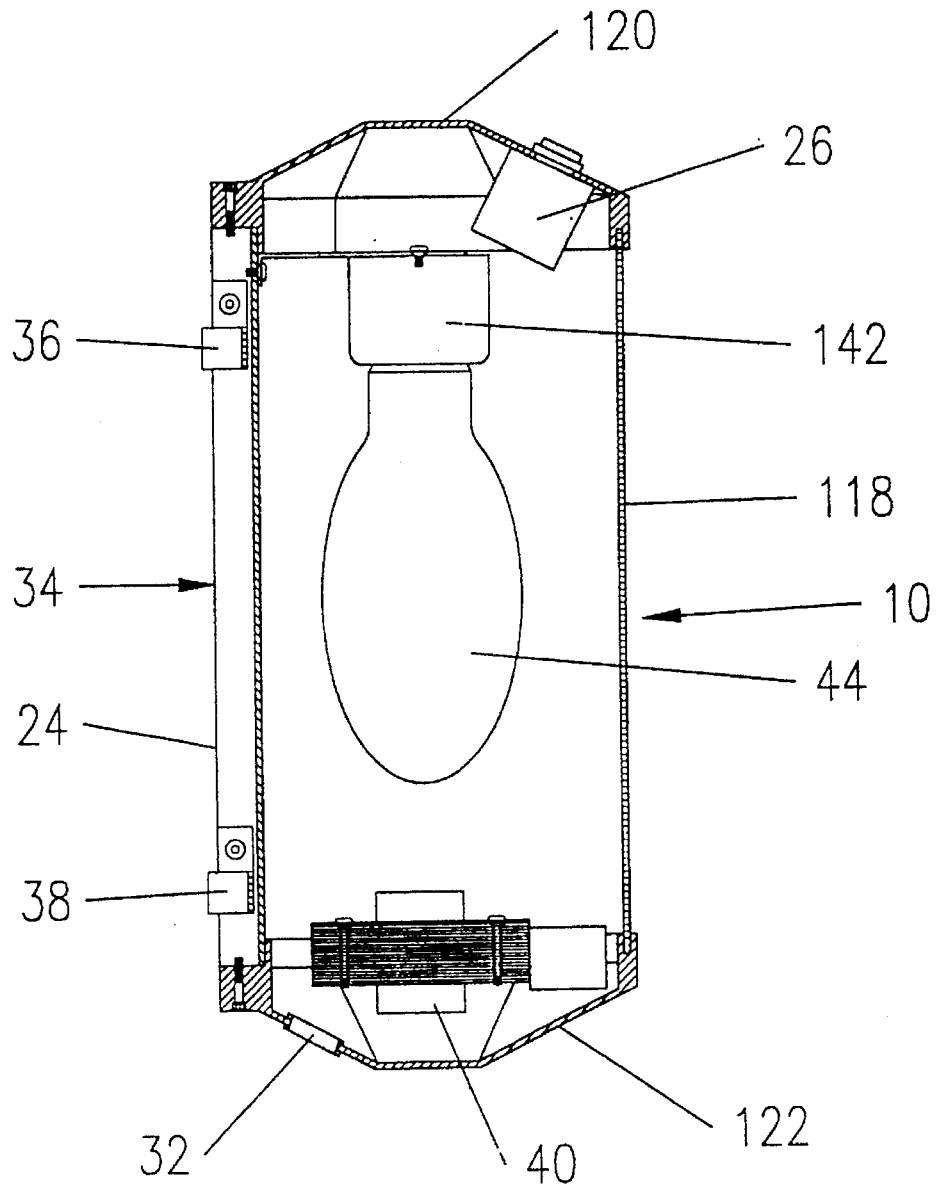
FIG. 3 shows a sectional view of an alternative light canister of the invention.
Figure 4:
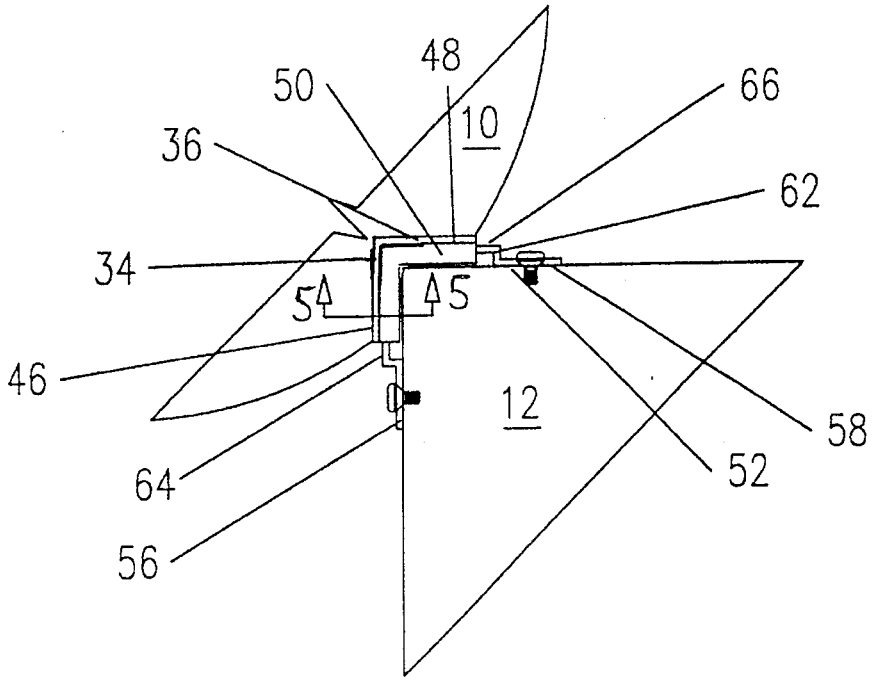
FIG. 4 shows a top view of the canister-wall attachment of the embodiment of FIG. 1.
Figure 5:
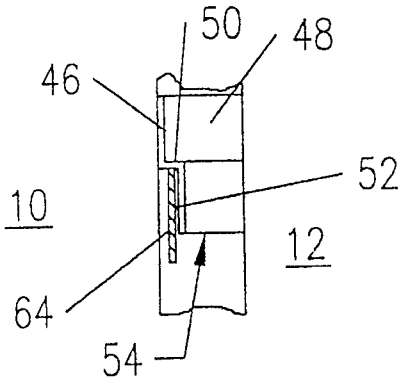
FIG. 5 shows a sectional side view of the canister-wall attachment of FIG. 4.
Figure 6:
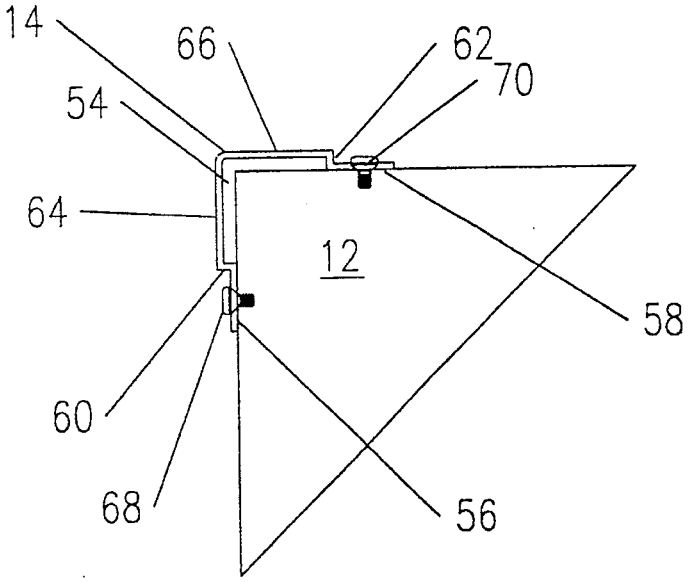
FIG. 6 shows a top view of the bracket of FIG. 4.

In the drawings numeral 10 generally indicates light canisters of the invention, in FIG. 1, canister 10 is mounted on wall 12, by wall brackets 14 and 16. As shown canister 10 includes acrylic lens 18, top end cup 20, bottom end cup 22, backpiece 24, photoelectric cell 26, and power cord 28. As shown in FIG. 2, backpiece 24 includes vertically extending right angled groove 34, in groove 34 are mounted upper mounting prong or hook 36 and lower mounting prong or hook 38, which engage wall brackets 14 and 16 respectively. Groove 34 extends upward into upper end cup 20 and downward into lower end cup 22. Photoelectric cell plugin 30 is mounted in upper end cap 20, while power cable grommet 32 is mounted in lower end cup 22, as is light ballast 40, light socket 42, and light bulb, or tube 44. The light canisters come in a range of sizes currently intended for 35–70 watts, 70–100 watts, 100–150 watts, and 150–400 watts, these are shown in FIGS. 1 and 2, and apart from dimensional differences are very closely similar, the canisters being about 5, 6, 7½ and 12 inches in diameter respectively, while their heights vary from about 13 inches up to 16 inches. As those skilled in the art would realize, if the light and suitable ballast generate too much heat then either the light power output is reduced or the canister size enlarged. Suitable canisters can be designed within the general structural limitations shown to accommodate lights of various outputs over a wide range. An alternative version shown in FIG. 3, has octagonal lens and end cups 120, 122, while light bulb or tube 44 is mounted from the top by socket 142. This smaller version is 4 inches across. The position of the junction box in the wall is irrelevant to the canister structure and position, as long as power connections can be easily made. Two wall brackets and paired associated prongs or hooks are found desirable to fix the canister in place so that it is not easily moved by wind and weather. The canister groove 34 has been found to be effective at 1 inch depth along the side for most purposes the smaller version shown in FIG. 3, has a depth of about ½ inch along the side.

The advantage of the corner mounted canister is to save energy and installation and fixture costs, by providing double duty service lighting both sides of a building or structure using a single fixture rather than the conventional two fixtures. It is preferred to use a high pressure sodium fixture, which produces about twice as much light output as mercury at the same wattage. Further the decline of high pressure sodium light output declines to a lesser extent than that of mercury, the decline being about half for lights of equal power over the same period. Another advantage is that high pressure sodium lights will relight typically about ½ to 1 minute after being tripped off due to a voltage surge, while mercury lights will relight typically in 4 to 5 minutes. Preferably power cable 28 is wired for 120 volts supply and is 2 feet in length, although as those skilled in the art would appreciate other power supply voltages and cable lengths can be utilized.

Prong or hook or hanger 36 has canister attachment plates 46 and 48 attached within groove 34, horizontal flange 50, and downward flange 52, which engages bracket 14 in space 54. Bracket 14 has wall attachment plates 56 and 58, which abut wall 12, projecting walls 60 and 62, and space forming walls 64 and 66. When mounted horizontal flange 50 rests on space forming walls 64 and 66, while downward flange 52 fits space 54 fairly snugly. Screws or bolts 68 and 70 are used to attach bracket 14 to wall 12.

As those skilled in the art would realize these preferred described embodiments can be subjected to substantial variation, modification, change, alteration, and substitution without affecting or modifying the function of the described embodiments. Although embodiments of the invention have been described above, it is not limited thereto, and it will be apparent to persons skilled in the art that numerous modifications and variations form part of the present invention insofar as they do not depart from the spirit, nature and scope of the claimed and described invention.

I claim:

1. Bracket means to removably mount a light canister on a protruding corner comprising first and second contact plate means angled to contact said corner and interconnecting means having end portions protruding outward from said first and second plate means, and a midportion spaced apart from said first and second plate means, so when said first and second plate means contact said corner said interconnecting means forms a space between said interconnecting means and said corner.

2. A bracket means of claim 1, wherein said space is V shaped.

3. A bracket means of claim 2, wherein said interconnecting means comprises first projecting means extending outward from said first contact plate means and second projecting means extending outward from said second contact plate means, and first extending means extending from said first projecting means to meet second extending means extending from said second projecting means.

4. A bracket means of claim 3, wherein said bracket means comprises first and second contact plate means mutually at right angles to contact said protruding corner, first projecting plate means extending outward substantially at right angles to said first contact plate means, second projecting plate means extending outward substantially at right angles to said second contact plate means, first extending plate means extending from said first projecting plate means, spaced apart from and parallel to said first contact plate means, to meet second extending plate means extending from said second projecting plate means, spaced apart from and parallel to said second contact plate means.

5. A bracket means of claim 4, wherein said first and second contact plate means comprise attachment aperture means.

6. Light canister means for removably mounting on a protruding corner, said canister having top wall means, bottom wall means, vertical backpiece means having top and bottom edges and opposed side edges, said backpiece means connecting said top and bottom wall means, light transmitting lens means extending between and contacting said top and bottom wall means and said side edges of said backpiece means, and light source means within said canister, said backpiece means comprising groove means extending vertically when said canister means is mounted vertically, said groove means having mounted therein hook means.

7. A light canister means of claim 6, wherein said groove means when generally vertical has a right angled generally horizontal cross section.

8. A light canister means of claim 7, wherein said hook means comprises groove contact plate means attached internally of said groove means, flange means extending into said groove means from a first edge abutting said groove contact plate means to a second edge spaced apart from said groove contact plate means and tab means extending along said groove means from said second edge means away from said groove contact plate means.

9. A light canister means of claim 8, wherein said groove contact plate means comprises first and second groove contact plate means conjoined at right angles, abutting said groove means, said flange means extends into said groove means at right angles to both said groove contact plate means, forming an L shape, and said tab means comprises first and second tab plate means conjoined at right angles to each other and said L shaped flange.

10. A light canister means of claim 9, wherein said first and second groove contact plate means comprise attachment aperture means.

11. A kit to mount a light canister comprising light canister means for removably mounting on a protruding corner said canister having top wall means, bottom wall means, vertical backpiece means having top and bottom edges and opposed side edges, said backpiece means connecting said top and bottom wall means, light transmitting lens means extending between and contacting said top and bottom wall means and said side edges of said backpiece means, and light source means within said canister, said backpiece means comprising groove means extending vertically when said canister means is mounted vertically hook means adapted to be mounted in said groove means bracket means to removably mount said light canister on a protruding corner comprising first and second corner contact plate means for said corner and interconnecting means having end portions protruding outward from said first and second plate means, and a midportion spaced apart from said first and second plate means, so when said first and second plate means contact said corner said interconnecting means forms a space between said interconnecting means and said corner said hook means having a dimensional cross section to engage said space.

12. A structure of claim 11, said groove having mounted therein said hook means.

13. A structure of claim 12, wherein said bracket means is mounted on said protruding corner, and said hook means engages said space.

14. A structure of claim 12, wherein said groove means when generally vertical has a right angled generally horizontal cross section.

15. A structure of claim 14, wherein said hook means comprises groove contact plate means attached internally of said groove means, flange means extending into said groove means from a first edge abutting said groove contact plate means to a second edge spaced apart from said groove contact plate means and tab means extending along said groove means from said second edge means away from said groove contact plate means.

16. A structure of claim 15 wherein said groove contact plate means comprises first and second groove contact plate means at right angles, abutting said groove means, said flange means extends into said groove means at right angles to both said groove contact plate means, forming an L shape, and said tab means comprises first and second tab plate means at right angles to each other and said L shaped flange, and said bracket means space is V shaped.

17. A structure of claim 16, wherein said first and second groove contact plate means are conjoined and said first and second tab plate means are conjoined.

18. A structure of claim 17, wherein said bracket interconnecting comprises first projecting means extending outward from said first corner contact plate means and second projecting means extending outward from said second corner contact plate means, and first extending means extending from said first projecting means to meet second extending means extending from said second projecting means.

19. A structure of claim 18, wherein said bracket means comprises first and second corner contact plate means mutually at right angles to contact said protruding corner, first projecting plate means extending outward substantially at right angles to said first contact plate means, second projecting plate means extending outward substantially at right angles to said second contact plate means, first extending plate means extending from said first projecting plate means, spaced apart from and parallel to said first contact plate means, to meet second extending plate means extending from said second projecting plate means, spaced apart from and parallel to said second contact plate means.

20. A structure of claim 18 wherein said first and second corner contact plate means and said first and second groove contact plate means comprise attachment aperture means.

* * * * *